US012680553B2

(12) United States Patent
Yao et al.

(10) Patent No.: US 12,680,553 B2
(45) Date of Patent: Jul. 14, 2026

(54) FAN WASHABLE WITH WATER

(71) Applicant: Ningbo Singfun Electric Appliance Co.,Ltd., Cixi (CN)

(72) Inventors: Yuchu Yao, Cixi (CN); Jitao Zhang, Cixi (CN); Lei Lan, Cixi (CN); Qingfeng Tong, Cixi (CN); Huabing Wang, Cixi (CN)

(73) Assignee: Ningbo Singfun Electric Appliance Co., Ltd., Zhejiang (CN)

( * ) Notice: Subject to any disclaimer, the term of this patent is extended or adjusted under 35 U.S.C. 154(b) by 3 days.

(21) Appl. No.: 18/758,645

(22) Filed: Jun. 28, 2024

(65) Prior Publication Data

US 2025/0361875 A1 Nov. 27, 2025

(30) Foreign Application Priority Data

May 22, 2024 (CN) ..... 202421125136.0

(51) Int. Cl.

| | |
|---|---|
| ***F04D 29/40*** | (2006.01) |
| ***F04D 25/06*** | (2006.01) |
| ***F04D 25/08*** | (2006.01) |
| ***F04D 29/70*** | (2006.01) |

(52) U.S. Cl.

CPC ..... *F04D 29/403* (2013.01); *F04D 25/06* (2013.01); *F04D 25/08* (2013.01); *F04D 29/70* (2013.01); *F04D 29/701* (2013.01); *F04D 29/703* (2013.01); *F04D 29/705* (2013.01)

(58) Field of Classification Search

CPC ..... F04D 25/06; F04D 25/08; F04D 29/403; F04D 29/70; F04D 29/701; F04D 29/703; F04D 29/705

See application file for complete search history.

(56) References Cited

U.S. PATENT DOCUMENTS 7,217,098 B2 * 5/2007 Lim ..... F04D 17/04 416/100
2014/0186197 A1 * 7/2014 Owusu ..... F04D 25/0693 417/326

FOREIGN PATENT DOCUMENTS

CN 206943054 U * 1/2018
CN 219412969 U * 7/2023

* cited by examiner

*Primary Examiner* — Mark A Laurenzi
(74) *Attorney, Agent, or Firm* — Sisson & Banyas, Attorneys at Law, LLC

(57) ABSTRACT

A fan washable with water, comprising a wind wheel and a driving motor which are arranged inside the shell; wherein a first partition plate is arranged on the top of the wind wheel; a second partition plate is arranged on the bottom of the wind wheel; and, the first partition plate and the second partition plate are hermetically engaged with the shell.

10 Claims, 3 Drawing Sheets

FAN WASHABLE WITH WATER

PRIORITIES AND CROSS REFERENCES

This application claims priority from Chinese Application No. 202421125136.0 filed on 22 May 2024, the teachings of which are incorporated by reference herein in their entirety.

TECHNICAL FIELD

The present application relates to a fan, and in particular to a fan washable with water.

BACKGROUND

Electrical appliances with wind outlet structures, such as fans and air conditioners, will have a lot of dust accumulated at wind inlets and wind outlets after a period of use, and are difficult to clean. At present, the wind inlet nets and wind outlet nets of some fans are detachable, and these components can be cleaned by users after being disassembled. However, tools are usually needed for disassembling or assembling, resulting in poor user experience. In addition, after the wind inlet nets and wind outlet nets are disassembled, users can easily touch rotating blades or moving parts, thus causing danger. Moreover, since circuits and electric appliances are arranged inside fans, it is usually impossible to wash fans with water.

CN214698405U disclosed a fan washable with water, wherein the motor assembly includes PCBA boards, a stator core and a rotor shaft; a positioning groove is formed in the center of the inner side of the rear cover; the PCBA boards are mounted within the positioning groove in pairs, and pouring glue is poured into the positioning groove to cover the PCBA boards, thereby ensuring that water will not penetrate into the positioning groove during washing, and ensuring that the PCBA boards are not affected by washing. The surface of the stator core is soaked with a waterproof conformal coating, so that the whole fan head has good waterproof performance, and the fan head can be directly washed with water. Only a small area can be sealed by pouring glue, and it is impossible to seal a larger area by pouring glue. In addition, the cost for sealing by pouring glue is also high.

Therefore, in the prior art, there is a need for a fan washable with water which can realize large-area waterproof sealing and can be convenient for washing with water and low in cost.

SUMMARY

An objective of the present application is to provide a fan washable with water. By arranging partition plates inside a shell, the region inside the fan washable with water is isolated, so that the product can be directly cleaned with water without affecting the service life of the product, the user experience can be effectively improved, and the cost is low.

The fan washable with water according to the present application includes a shell, wherein wind inlets and wind outlets are arranged on the shell; a wind wheel and a driving motor are arranged inside the shell; a first partition plate is arranged on the top of the wind wheel; a second partition plate is arranged on the bottom of the wind wheel; and, the first partition plate and the second partition plate are hermetically engaged with the shell. Preferably, a third partition plate may also be arranged on the bottom of the shell.

A top cover assembly is arranged above the first partition plate; the top cover assembly includes an electronic board and an electronic board protective box; the wind wheel is fixed on the shell through a wind wheel cap bracket; the wind wheel cap bracket and the first partition plate are fixed on the shell; the electronic board protective box is arranged above the wind wheel cap bracket; the electronic board is arranged within the electronic board protective box; a top cover is further arranged above the electronic board; and, a control panel is arranged above the top cover.

A motor assembly may be arranged below the second partition plate, the motor assembly may include a motor for driving the wind wheel to rotate, and the motor is fixedly mounted on the shell through a motor bracket; a synchronous motor is arranged below the motor bracket, the synchronous motor is fixed on a synchronous motor bracket, and the synchronous motor bracket is fixed on the shell; the synchronous motor is connected to a rotating tray through a connecting rod and an eccentric component, and the rotating tray is mounted on a chassis through a rotating tray cover; and, the third partition plate is arranged between the rotating tray cover and the chassis, and the third partition plate is fixedly arranged on the shell.

Preferably, a water outlet may be arranged at a position on the shell near at least one of the first partition plate, the second partition plate and the third partition plate; a top shaft is arranged on the top of the wind wheel, and a mounting portion is arranged on the bottom thereof; the first partition plate is arranged at the top shaft; the second partition plate is arranged at the mounting portion; and, a seal ring may be arranged between at least one of the first partition plate, the second partition plate and the third partition plate and the shell.

In the fan washable with water according to the present application, the product can be directly cleaned with water without disassembling the fan. Specifically, by arranging the partition plates inside the shell and sealing them in the whole machine, the components in the whole machine are located in a relatively closed space. Since the water inlets and water outlets are formed at the corresponding assembly positions of the fan shell and the partition plates, after a water flow flows to the partition plates, the water can quickly flow out of the whole machine through these additional water outlets. In the present application, in the above way, when a user cleans this product with water, most of the water flow will be isolated from the components, thereby improving the service life of the product. Moreover, the closed space is formed by using the partition plates, so that the cost is very low and it is helpful in cost reduction.

DETAILED DESCRIPTION

To make the objectives, technical solutions and advantages of the present application clearer, the embodiments of the present application will be described below in detail with reference to the accompanying drawings. It is to be noted that the embodiments in the present application and the features in the embodiments can be arbitrarily combined with each other if not conflicted.

Figure 1:
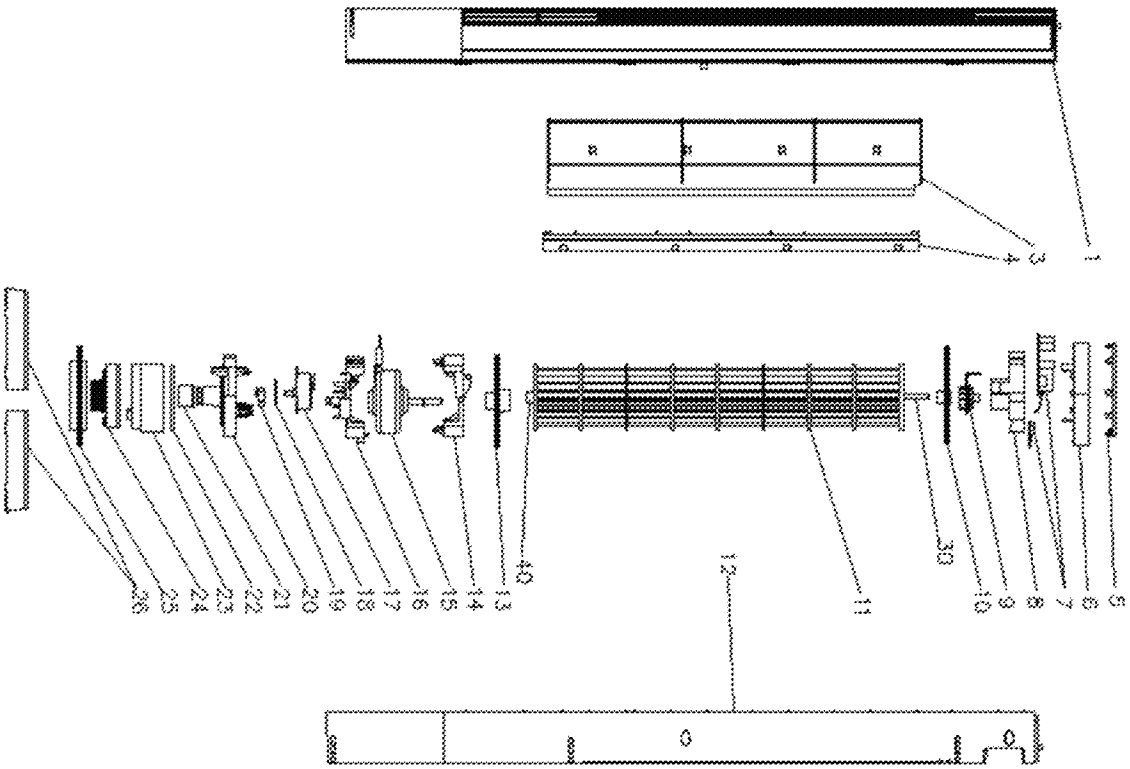
FIG. 1 is an exploded view of the fan washable with water according to the present application.
Figure 2:
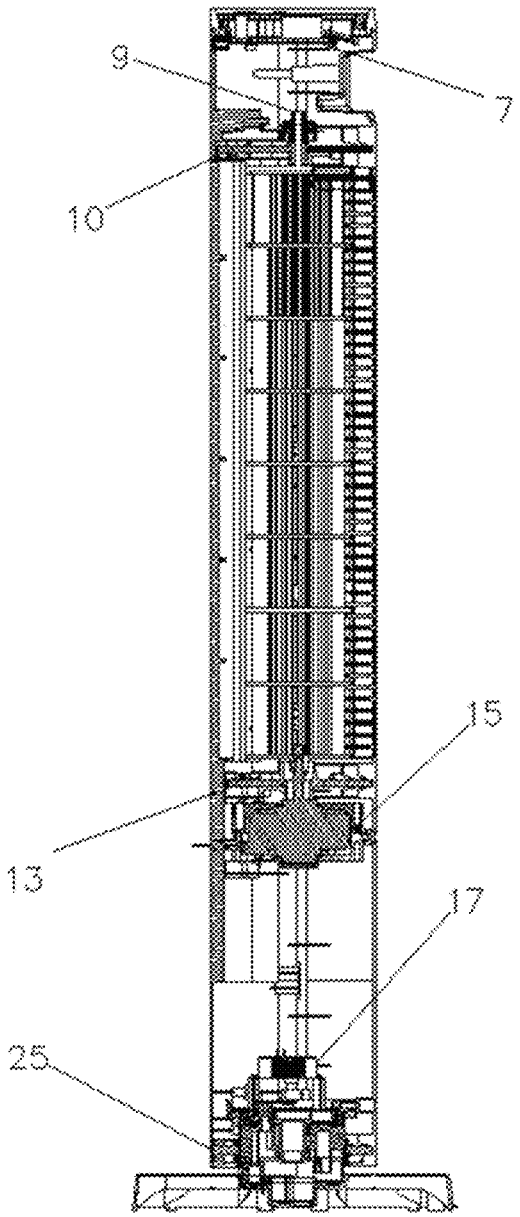
FIG. 2 is a sectional view of the fan washable with water according to the present application.
Figure 3:
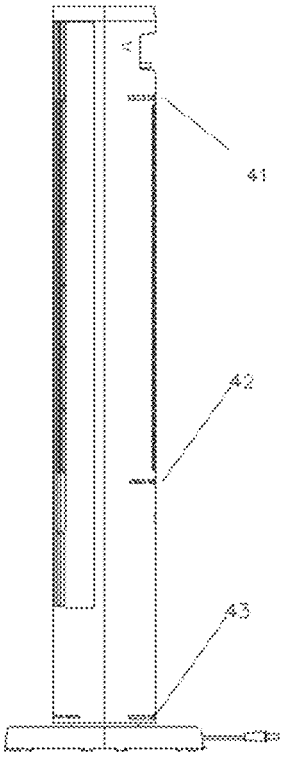
FIG. 3 is a side view of the fan washable with water according to the present application.

As shown in FIGS. 1-3, the fan washable with water according to the present application includes a shell. Wind inlets and wind outlets are arranged on the shell. A wind wheel 11 and a driving motor 15 are arranged inside the shell. An upper partition plate 10 is arranged on the top of the wind wheel 11, and a middle partition plate 13 is arranged on the bottom of the wind wheel. Specifically, the upper partition plate 10 may be arranged at a top shaft 30 of the wind wheel, and the middle partition plate 13 may be arranged at a bottom mounting portion 40 of the wind wheel. Preferably, a lower partition plate 25 may also be arranged on the bottom of the shell. The shell may include a front shell 1 and a rear shell 12 which are buckled with each other to form a whole structure, the wind inlets may be arranged on the rear shell 12, and the wind outlets may be arranged on the front shell 1. The upper partition plate 10 and the middle partition plate 13 are hermetically engaged with the shell. Preferably, a seal ring may be provided. Thus, a separate water washable region is formed in the region where the wind wheel 11 is located, and the wind inlets and the wind outlets can be washed with water. It is known to those skilled in the art, other regions in the shell except for the region of the wind wheel can be waterproof by the existing sealing means, and the details will not be repeated here. The arrangement of the lower partition plate 25 can prevent water from flowing into the operating space of the synchronous motor from the lower portion of the fan. It is also possible to not provide the lower partition plate 25, and the part below the middle partition plate 13 is arranged as the whole closed region.

As shown in FIG. 1, a guiding plate 3 and a blocking plate 4 are also fixed inside the shell. The guiding plate 3 and the blocking plate 4 may be arranged on the front shell 1 in a way in the prior art, and the details will not be repeated here. A top cover assembly is arranged above the upper partition plate 10. The top cover assembly includes a control panel 5, a top cover 6, an electronic board 7 and an electronic board protective box 8. The upper partition plate 10 is fixed on the front shell 1 through a limiting rib. Preferably, a seal ring may also be arranged at a contact position of the upper partition plate 10 with the shell. The wind wheel 11 is fixed on the shell through a wind wheel cap bracket 9, the electronic board protective box 8 is arranged above the wind wheel cap bracket 9, the electronic board 7 is arranged in the electronic board protective box 8 and covered by the top cover 6, and the control panel 5 is arranged above the top cover 6. In the present application, by providing the upper partition plate 10 and sealing the top cover assembly above the upper partition plate 10, the water flowing through the wind inlets and the wind outlets at the wind wheel cannot flow into the top cover assembly when the fan is washed with water, thereby protecting the electric appliances in the top cover assembly.

A motor assembly is arranged below the middle partition plate 13. The motor assembly includes a driving motor 15 used for driving the wind wheel 11 to rotate. The driving motor 15 may be fixedly mounted on the shell through an upper motor bracket 14 and a lower motor bracket 16. A synchronous motor 17 is arranged below the lower motor bracket 16, the synchronous motor 17 is fixed on a synchronous motor bracket 20, and the synchronous motor bracket 20 is fixed on the shell. The synchronous motor 17 is connected to a rotating tray 23 through a connecting rod 18 and an eccentric component 19. The eccentric component 19 may be fixed on the synchronous motor 17 through a pin, and the connecting rod 18 may be fixed on the eccentric component 19 through a screw. A shaft sleeve 21 is arranged on the bottom of the synchronous motor bracket 20, the shaft sleeve 21 may be fixed on the rotating tray 23 through a limiting column, and a friction plate 22 is fixed on the rotating tray 23 through a limiting column. The rotating tray 23 is mounted on a chassis 26 through a rotating tray cover 24. The lower partition plate 25 is arranged between the rotating tray cover 24 and the chassis 26, and may be fixed on the front shell by using a limiting rib.

As shown in FIG. 3, an upper water outlet 41 and a middle water outlet 42 are formed on the shell near the upper partition plate 10 and the middle partition plate 13, respectively, to allow all water possibly existing in the shell to flow out. During washing, water can flow in through the wind inlets and the wind outlets to clean the wind wheel, without flowing into the motor assembly and the head shaking assembly below the top assembly or the wind wheel. Preferably, a lower water outlet 43 may also be formed below the lower partition plate 25 to avoid water accumulation. In the present application, the water washing region is isolated from other electric regions by providing the partition plates, so that the whole fan can be cleaned, and the cost is low.

The fan washable with water according to the present application has the following technical advantages.

(1) In the present application, by providing partition plates, the region in which the wind wheel is located is separated from the regions where the upper and lower parts are located, so that only the region where the wind wheel is located is cleaned during washing the whole machine, that is, the wind wheel and the front and rear wind inlets are mainly cleaned. The washing water will not affect other circuit regions, so that the requirements for washing the whole machine are satisfied.

(2) In the present application, the requirements for washing the whole machine are satisfied by providing partition plates, so that the cost is reduced, and the requirements for large-area washing can be satisfied.

Although the implementations disclosed by the present application have been described above, the contents described are only implementations used for understanding the present application and not intended to limit the present application. Without departing from the spirit and scope disclosed by the present application, any person skilled in the art to which the present application belongs can make any modifications and alterations to the forms and details of implementation. However, the protection scope of the present application shall still be subject to the scope defined by the appended claims.

The invention claimed is:

1. A fan washable with water, comprising a shell, wherein wind inlets and wind outlets are arranged on the shell; a wind wheel and a driving motor are arranged inside the shell; a first partition plate is arranged on the top of the wind wheel; a second partition plate is arranged on the bottom of the wind wheel; the first partition plate and the second partition plate are hermetically engaged with the shell;

wherein a motor assembly is arranged below the second partition plate, the motor assembly comprises the driving motor for driving the wind wheel to rotate, and the driving motor is fixedly mounted on the shell through a motor bracket;

a synchronous motor is arranged below the motor bracket; the synchronous motor is fixed on a synchronous motor bracket; the synchronous motor bracket is fixed on the shell; the synchronous motor is connected to a rotating tray through a connecting rod and an eccentric component; and, the rotating tray is mounted on a chassis through a rotating tray cover.

2. The fan washable with water according to claim 1, wherein a top shaft is arranged on the top of the wind wheel, and a mounting portion is arranged on the bottom thereof; the first partition plate is arranged at the top shaft; and, the second partition plate is arranged at the mounting portion.

3. The fan washable with water according to claim 1, wherein a top cover assembly is arranged above the first partition plate; the top cover assembly comprises an electronic board and an electronic board protective box; the wind wheel is fixed on the shell through a wind wheel cap bracket; the wind wheel cap bracket and the first partition plate are fixed on the shell; the electronic board protective box is arranged above the wind wheel cap bracket; and, the electronic board is arranged within the electronic board protective box.

4. The fan washable with water according to claim 3, wherein a top cover is further arranged above the electronic board, and a control panel is arranged above the top cover.

5. The fan washable with water according to claim 1, wherein a third partition plate is arranged between the rotating tray cover and the chassis, and the third partition plate is fixedly arranged on the shell.

6. The fan washable with water according to claim 5, wherein a seal ring is arranged between at least one of the first partition plate, the second partition plate and the third partition plate arranged between the rotating tray cover and the chassis and the shell.

7. The fan washable with water according to claim 1, wherein a third partition plate is arranged on the bottom of the shell.

8. The fan washable with water according to claim 2, wherein a water outlet is arranged at a position on the shell near at least one of the first partition plate, the second partition plate and the third partition plate arranged on the bottom of the shell.

9. The fan washable with water according to claim 7, wherein a top shaft is arranged on the top of the wind wheel, and a mounting portion is arranged on the bottom thereof; the first partition plate is arranged at the top shaft; and, the second partition plate is arranged at the mounting portion.

10. The fan washable with water according to claim 7, wherein a seal ring is arranged between at least one of the first partition plate, the second partition plate and the third partition plate arranged on the bottom of the shell and the shell.

* * * * *